US006540004B2

(12) United States Patent
Wu

(10) Patent No.: US 6,540,004 B2
(45) Date of Patent: Apr. 1, 2003

(54) FIXING SEAT STRUCTURE OF ROLLING CURTAIN

(75) Inventor: Tetsun Wu, Changhua Hsien (TW)

(73) Assignee: Yuh San Corp. Ltd., Changhua Hsien (TW)

( * ) Notice: Subject to any disclaimer, the term of this patent is extended or adjusted under 35 U.S.C. 154(b) by 0 days.

(21) Appl. No.: 09/934,534

(22) Filed: Aug. 23, 2001

(65) Prior Publication Data

US 2003/0037889 A1 Feb. 27, 2003

(51) Int. Cl.[7] ..... A47H 1/00
(52) U.S. Cl. ..... 160/321; 160/323.1
(58) Field of Search ..... 160/321, 323.1, 160/319, 903, 320, 307

(56) References Cited

U.S. PATENT DOCUMENTS 3,854,517 A * 12/1974 Nakamura ..... 160/323.1
5,092,389 A * 3/1992 Tedeschi ..... 160/321
5,975,186 A * 11/1999 Day ..... 160/321

* cited by examiner

*Primary Examiner*—David M. Purol
(74) *Attorney, Agent, or Firm*—Troxell Law Office PLLC

(57) ABSTRACT

Fixing seat structure of rolling curtain including a left fixing seat, a reel, a fabric curtain, a rotary unit, an engaging pivot member and a right fixing seat. The inner side of the left fixing seat has a fitting block the center of which is formed with a fitting channel. The ends in the fitting channel are all formed with a hooking recess. The center of outer end of the rotary unit is provided with a fitting block. The rear end of the fitting block is connected with a hooking block. A pull cord and a rotary body connected with the pull cord are disposed on the rotary unit. The outer end of the engaging pivot body is formed with a stepped fitting post the large diameter section of which forms a pivotal latch button. A sleeve is formed on inner side of the engaging pivot body. The inner side of the right fixing seat is formed with a guide channel. The front side of middle section of the guide channel communicating with a pivotal fitting socket. The bottom of the pivotal fitting socket is formed with a pivotal latch socket with larger diameter.

2 Claims, 5 Drawing Sheets

FIXING SEAT STRUCTURE OF ROLLING CURTAIN

BACKGROUND OF THE INVENTION

The present invention is related to a fixing seat structure of rolling curtain. The left and right fixing seats are respectively pivotally engaged with a rotary unit and an engaging pivot body. The left and right fixing seats can be inward biased to pivotally engaged with the rotary unit and the engaging pivot body. Even if the left and right fixing seats are not precisely locked in alignment with each other or are spaced from each other by too long distance, the reel still will not transversely displace and detach and drop down.

FIG. 1 shows a fixing seat for conventional rolling curtain including two fixing blocks 1, 2, a reel 3, a curtain fabric 4, a rotary unit 5 and a retainer 6. When assembled, the rotary unit 5 and the retainer 6 are first fitted into two ends of the reel 3. Then, the fitting post 5' of the rotary unit 5 and the fitting post 6' of the retainer 6 are respectively inserted and located in the sockets 1', 2' of the right and left fixing blocks 1, 2.

The above conventional structure has some shortcomings as follows:

1. The retainer 6 and the rotary unit 5 are simply fitted with the right and left fixing blocks 1, 2 without engaging therewith. Therefore, in the case that when mounted, the right and left fixing blocks 1, 2 are deflected by a certain angle, a gap A will exist between the retainer 6 or the rotary unit 5 and the right and left fixing blocks 1, 2. Accordingly, when a user downward pulls the cord 52 for upward rolling or downward unrolling the curtain fabric 4, due to the gap A, the fitting posts 5', 6' of the rotary unit 5 and the retainer 6 tend to up and down or left and right displace within the sockets 1', 2' of the right and left fixing blocks 1, 2. As a result, the fitting posts 5', 6' may be unplugged from the sockets 1', 2' and the reel 3 may transversely displace and drop down as shown by the arrow of FIG. 1. The dropping curtain may hurt the user.
2. The retainer 6 and the rotary unit 5 are simply fitted with the right and left fixing blocks 1, 2 without engaging therewith. Therefore, in the case that the right and left fixing blocks 1, 2 are locked and spaced from each other by a long distance, when operated, the reel 3 also tends to transversely displace and drop down. Therefore, the safety in use of the rolling curtain can be hardly ensured.

FIG. 2 shows another type of fixing block of conventional rolling curtain including two fixing blocks 1, 2, a reel 3, a curtain fabric 4, a rotary unit 5, a retainer 6 and a resilient U-shaped engaging block 7. When assembled, the rotary unit 5 and the retainer 6 are first fitted into two ends of the reel 3. Then, the fitting block 5' of the rotary unit 5 and the fitting post 6' of the retainer 6 are respectively inserted into the sockets 1', 2' of the right and left fixing blocks 1, 2. Then, the U-shaped engaging block 7 is engaged between the right fixing block 1 and the fitting post 6' of the retainer 6. Under such circumstance, the fitting post 6' of the retainer 6 is prevented from upward or downward displacing.

The above conventional structure has some shortcomings as follows:

1. The retainer 6 and the rotary unit 5 are simply fitted with the right and left fixing blocks 1, 2 without engaging therewith. The resilient engaging block 7 is engaged between the right fixing block 1 and the fitting post 6' of the retainer 6. Therefore, in the case that when mounted, the right and left fixing blocks 1, 2 are deflected by a certain angle, a transverse gap will exist between the retainer 6 or the rotary unit 5 and the right and left fixing blocks 1, 2. Accordingly, the distance between the socket 1' of the right fixing block 1 and the fitting post 6' of the retainer 6 will be too long. Therefore, when a user downward pulls the cord 52 for upward rolling or downward unrolling the curtain fabric 4, due to the gap, the fitting posts 5', 6' of the rotary unit 5 and the retainer 6 tend to left or right displace from the sockets 1', 2' of the right and left fixing blocks 1, 2. As a result, the reel 3 may transversely displace and drop down as shown by the arrow of FIG. 2. The engaging block 7 only serves to prevent the fitting posts from vertically displacing so that the curtain still may drop down to hurt the user.
2. The retainer 6 and the rotary unit 5 are simply fitted with the right and left fixing blocks 1, 2 without engaging therewith. Therefore, in the case that the right and left fixing blocks 1, 2 are locked and spaced from each other by a long transverse distance, when operated, the reel 3 also tends to transversely displace. The engaging block 7 only serves to prevent the fitting posts from vertically displacing so that the curtain still may drop down to hurt the use. Therefore, the safety in use of the rolling curtain can be hardly ensured.

SUMMARY OF THE INVENTION

It is therefore a primary object of the present invention to provide a fixing seat structure of rolling curtain in which the left and right fixing seats are respectively pivotally engaged with the rotary unit and the engaging pivot body. Therefore, when mounted, in the case that the left and right fixing seats are not precisely locked and are deflected by a certain angle, the left and right fixing seats can still truly attach to the rotary unit and the engaging pivot body without any gap. Therefore, when a user downward pulls the cord, the shock will not make the pivotal latch button and the hooking block jump away or make the reel transversely displace and detach and drop down. Therefore, the safety in use can be ensured.

It is a further object of the present invention to provide the above fixing seat structure in which the left and right fixing seats can be inward biased to pivotally engage with the rotary unit and the engaging pivot body. Therefore, in the case that the right and left fixing seats are spaced from each other by too long distance, after pivotally engaged, the left and right fixing seats will not bound back and the reel will not transversely displace and detach and drop down.

The present invention can be best understood through the following description and accompanying drawings wherein:

DETAILED DESCRIPTION OF THE PREFERRED EMBODIMENT

Figure 3:
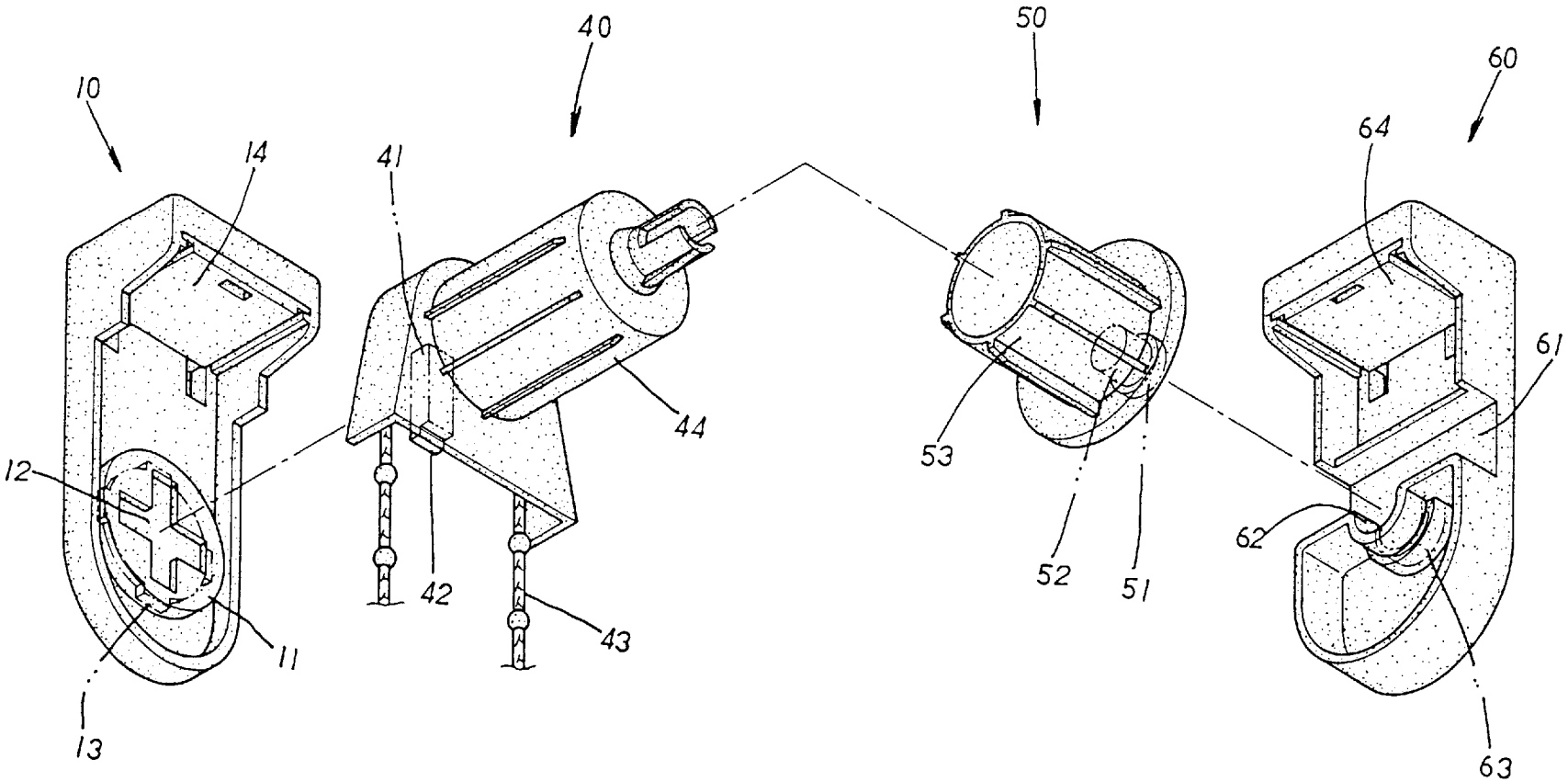
FIG. 3 is a perspective exploded view of the present invention.

Please refer to FIG. 3. The present invention includes a left fixing seat 10, a reel 20, a fabric curtain 30, a rotary unit 40, an engaging pivot member 50 and a right fixing seat 60. The left and right fixing seats 10, 60 are both made of plastic material. The front section of inner side of the left fixing seat 10 has a projecting fitting block 11. The center of the fitting block 11 is formed with a cross-shaped fitting channel 12. The four ends in the fitting channel 12 are all formed with an outward extending hooking recess 13. The rear section of inner side of the left fixing seat 10 is fitted with a cover body 14 for shielding locking screws (not shown). The center of outer end of the fitting body on one side of the rotary unit 40 is provided with a rectangular fitting block 41 with a certain dimension. The rear end of the fitting block 41 is connected with a small diameter hooking block 42. A pull cord 43 is disposed on the rotary unit 40. In addition, a rotary body 44 is disposed on the other side of the rotary unit 40 opposite to the fitting body. The rotary body 44 is connected with the pulling structure of the pull cord 43. The center of outer end of the engaging pivot body 50 is formed with a stepped fitting post 51 with larger outer section and smaller inner section. The large diameter section of the fitting post 51 forms a pivotal latch button 52. The inner side is provided with a sleeve 53 for fitting with the reel 20. The center of inner side of the right fixing seat 60 is formed with a guide channel 61. The front side of middle section of the guide channel 61 communicates with a pivotal fitting socket 62. The bottom of the pivotal fitting socket 62 is formed with a pivotal latch socket 63 with larger diameter. The rear section of inner side of the right fixing seat 60 is fitted with a cover body 64 for shielding the locking screws (not shown).

Figure 4:
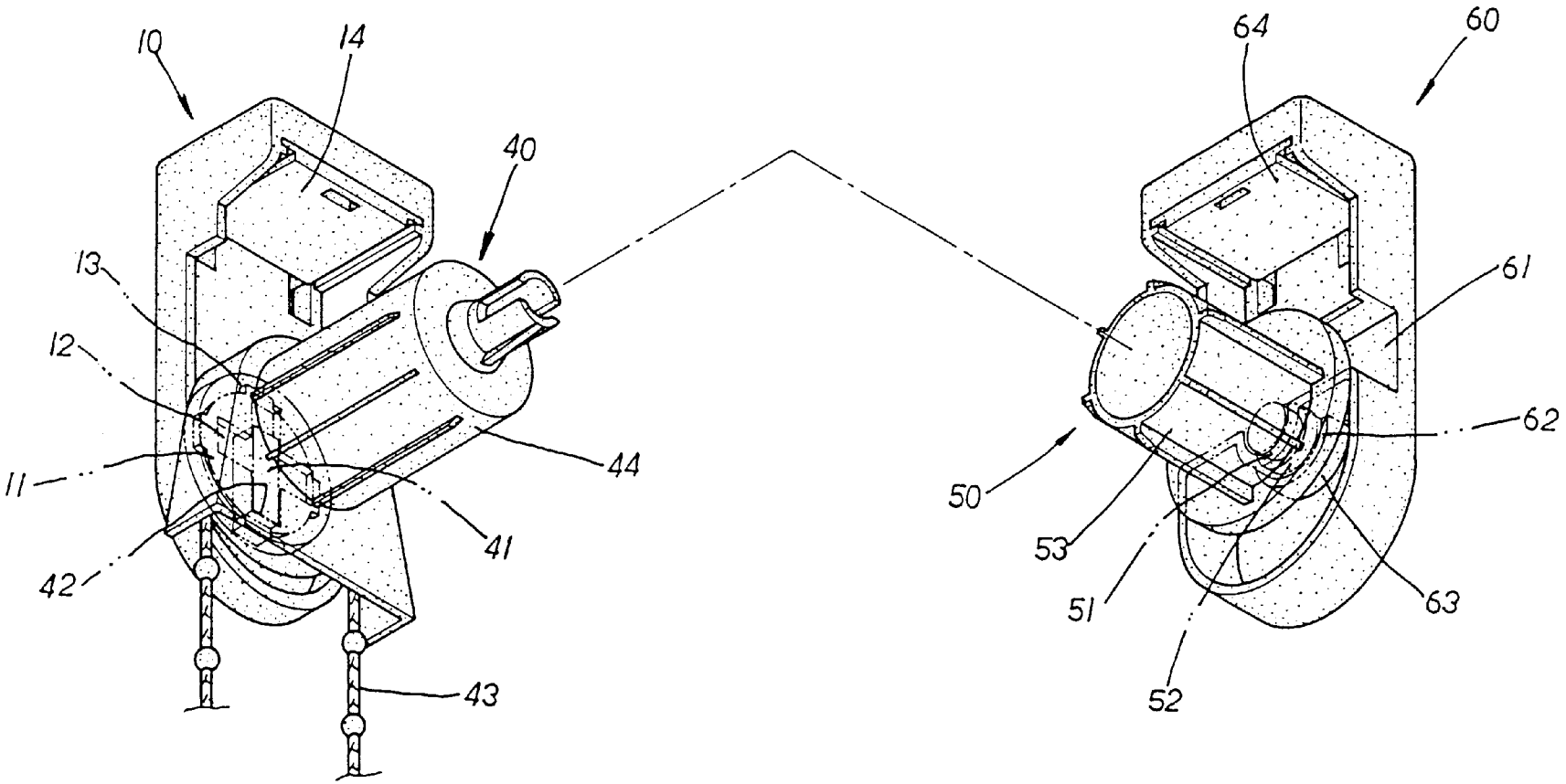
FIG. 4 is a perspective assembled view of the present invention.
Figure 5:
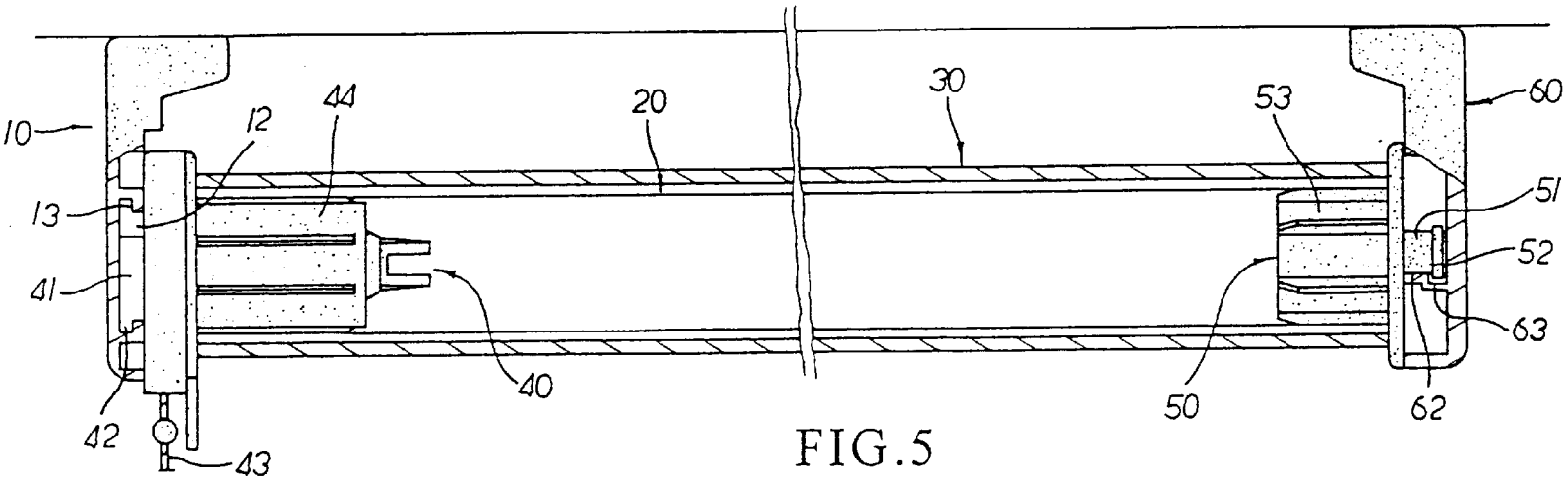
FIG. 5 is a sectional assembled view of the present invention.

When assembled, as shown in FIGS. 4 and 5, the left and right fixing seats 10, 60 are first locked on suitable positions of the wall of ceiling and fitted with the cover bodies 14, 64 for shielding the locking screws. The fabric curtain 30 is wound around the reel 20. Then the rotary body 44 of the rotary unit 40 and the sleeve 53 of the engaging pivot body 50 are respectively fixedly fitted with two ends of the reel 20. The fitting block 41 of the rotary unit 40 is fitted into the fitting channel 12 of the left fixing seat 10. Thereafter, a downward pressing force is exerted onto the rotary unit 40 to make the hooking block 42 thereof latched in the hooking recess 13 of the left fixing seat 10. Then, the fitting post 51 of the engaging pivot body 50 is pivotally fitted into the guide channel 61 of the right fixing seat 60. The fitting post 51 is also slidably fitted into the pivotal fitting socket 62 of the right fixing seat 60. The pivotal latch button 52 is at the same time pivotally latched in the pivotal latch socket 63 of the right fixing seat 60. At this time, by means of the pivotal engagement between the rotary unit 40 and the engaging pivot body 50, the reel 20 is firmly located on the left and right fixing seats 10, 60. Also, the cord 43 can be downward pulled to upward roll the fabric curtain 30 or downward unroll the fabric curtain 30.

Figure 1:
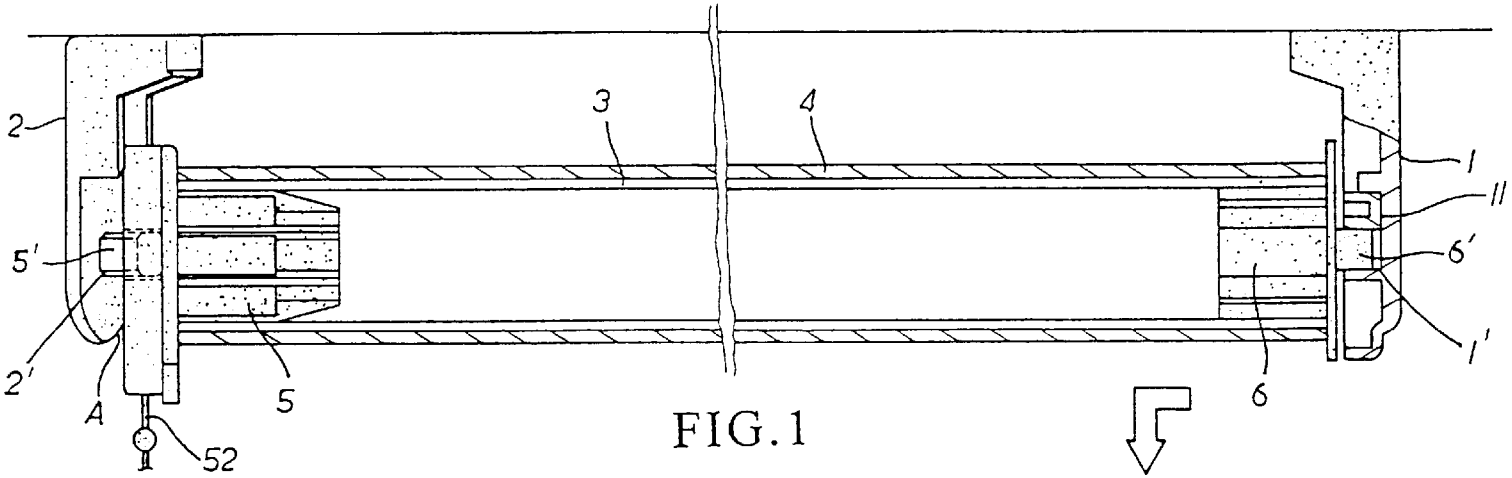
FIG. 1 PRIOR ART
FIG. 1 shows that conventional fixing blocks of rolling curtain are deflected.
Figure 6:
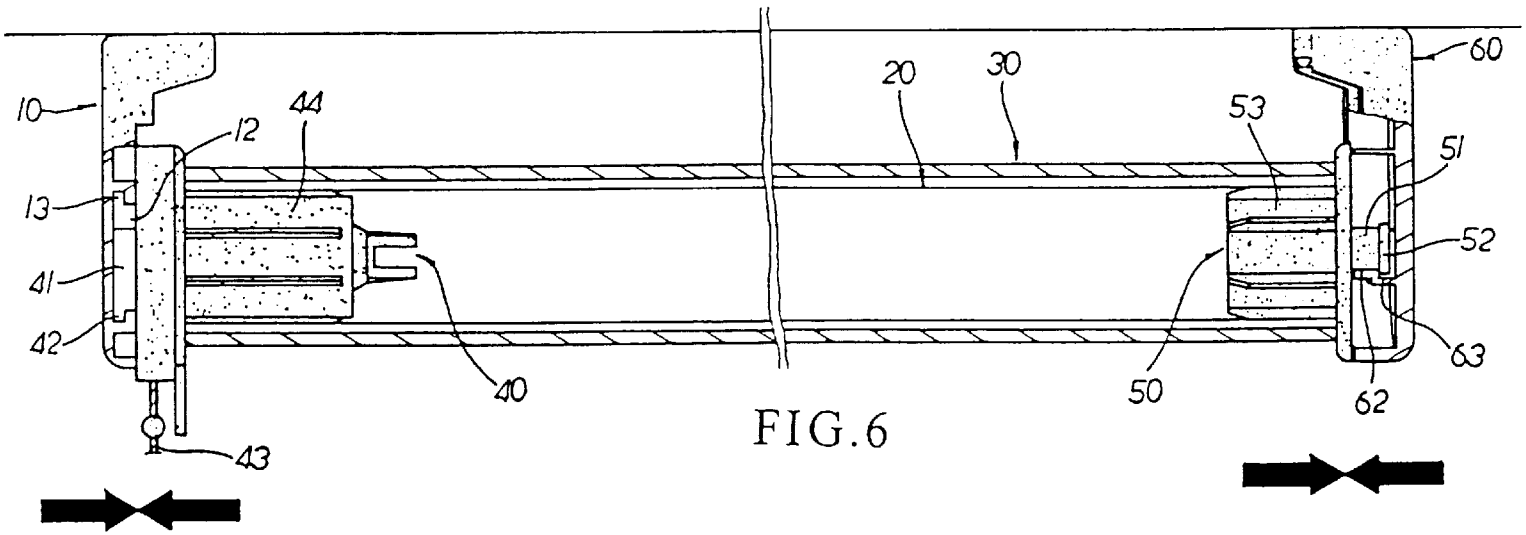
FIG. 6 shows that the fixing seats of the present invention are not locked in alignment with each other.
Figure 2:
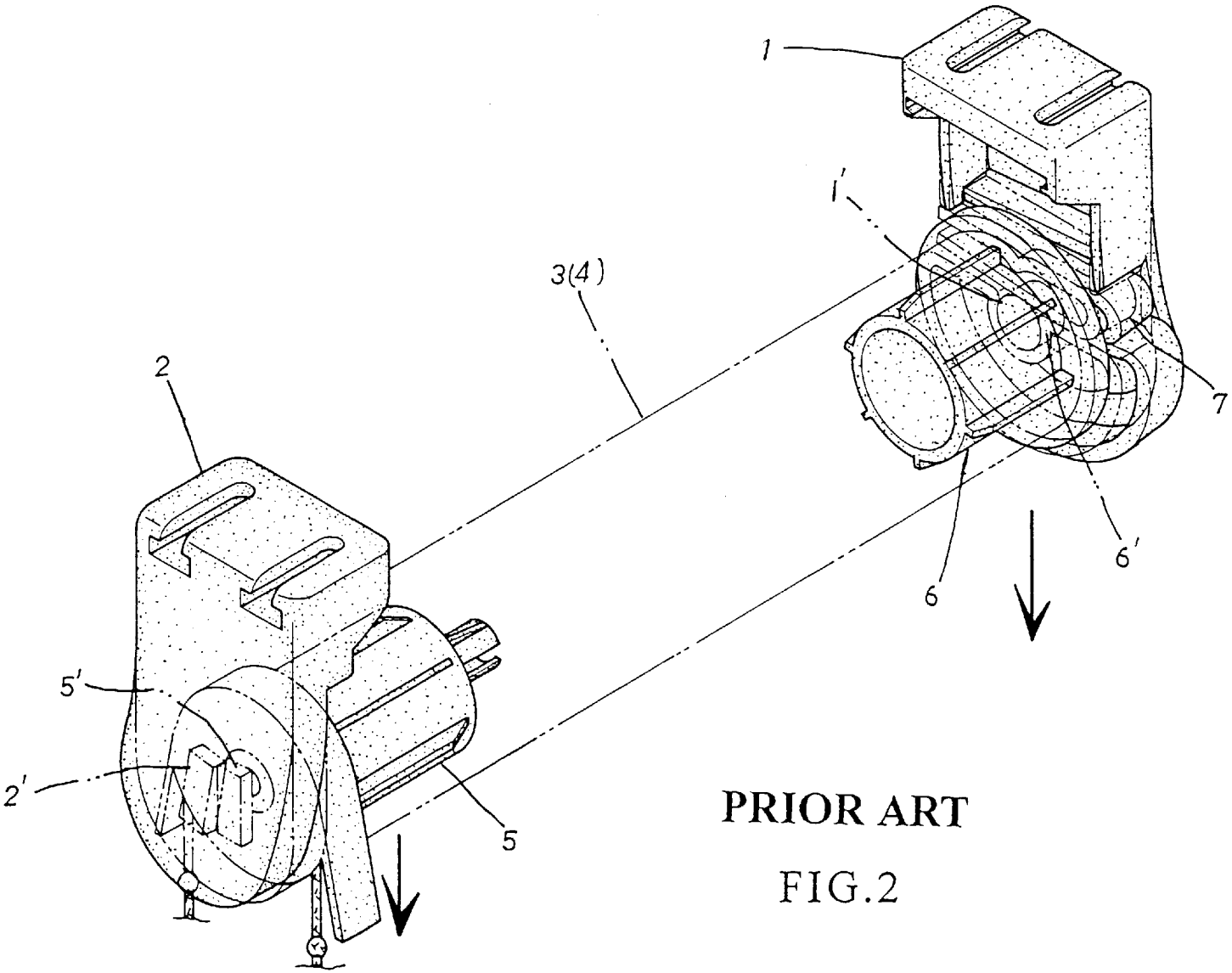
PRIOR ART FIG.2
FIG. 2 shows that another type of conventional fixing blocks of rolling curtain are deflected.
Figure 7:
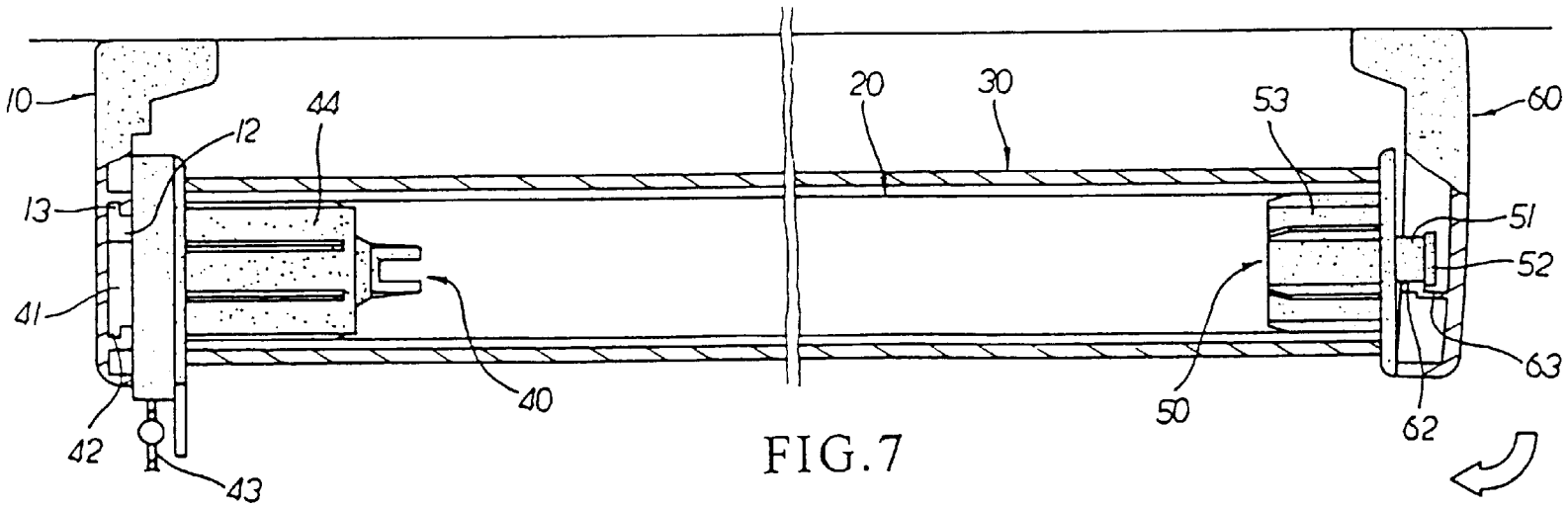
FIG. 7 shows that the fixing seats of the present invention are locked and spaced from each other by too long distance and are biased.

The left and right fixing seats 10, 60 are respectively pivotally engaged with the rotary unit 40 and the engaging pivot body 50. Therefore, when mounted, in the case that the left and right fixing seats 10, 60 are not precisely locked in alignment with each other and are deflected by a certain angle (as shown in FIG. 6), by means of the latching of the hooking block 42 of the rotary unit 40 with the hooking recess 13 of the left fixing seat 10, no gap will exist between the rotary unit 40 and the left fixing seat 10. Also, the pivotal latch button 52 of the engaging pivot body 50 is latched with the pivotal latch socket 63 of the right fixing seat 60 and the fabric curtain 30 is vertically pulled, no gap will form between the engaging pivot body 50 and the right fixing seat 60. Therefore, even if the left and right fixing seats 10, 60 are not precisely locked and are deflected by a certain angle, the reel 20 can be still truly located. In addition, the left and right fixing seats 10, 60 are both made of plastic material. Therefore, in the case that the right and left fixing seats 10, 60 are locked and spaced from each other by too long distance (as shown in FIG. 7), the left and right fixing seats 10, 60 can be biased toward the reel 20 to pivotally engage with the rotary unit 40 and the engaging pivot body 50. The hooking block 42 of the rotary unit 40 will be always latched in the hooking recess 13 of the left fixing seat 10 and the pivotal latch button 52 of the engaging pivot body 50 will be also always latched in the pivotal latch socket 63 of the right fixing seat 60. Therefore, after the external force disappears, the left and right fixing seats 10, 60 will not bound back due to the plasticity thereof. Accordingly, the reel 20 will not be untruly located due to the excessively long distance between the left and right fixing seats 10, 60.

According to the above arrangement, the present invention has the following advantages:

1. The left and right fixing seats 10, 60 are respectively pivotally engaged with the rotary unit 40 and the engaging pivot body 50. Therefore, when mounted, in the case that the left and right fixing seats 10, 60 are not precisely locked and are deflected by a certain angle, the left and right fixing seats 10, 60 can still truly attach to the rotary unit 40 and the engaging pivot body 50 without any gap. Therefore, when a user downward pulls the cord 43, the shock will not make the pivotal latch button 52 and the hooking block 42 jump away or make the reel 20 transversely displace and detach and drop down. Therefore, the safety in use can be ensured.
2. The left and right fixing seats 10, 60 can be inward biased to pivotally engage with the rotary unit 40 and the engaging pivot body 50. Therefore, in the case that the right and left fixing seats 10, 60 are spaced from each other by too long distance, after pivotally engaged, the left and right fixing seats 10, 60 will not bound back and the reel 20 will not transversely displace and detach and drop down.

The above embodiment is only used to illustrate the present invention, not intended to limit the scope thereof. Many modifications of the above embodiment can be made without departing from the spirit of the present invention.

What is claimed is:

1. A fixing seat structure for a rolling curtain including a fabric curtain on a reel, the reel having first and second opposite ends, the fixing seat structure comprising:

a) first and second spaced apart fixing seats, the first fixing seat including a projecting first fitting block with a hooking recess and a fitting channel communicating with the hooking recess, the second fixing seat including a guide channel with a fitting socket, including a pivotal latch socket, in communication with the guide channel;

b) a rotary unit on the first end of the reel and including a second fitting block engaging the fitting channel, the second fitting block having a hooking block engaging the hooking recess; and c) an engaging pivot member on the second end of the reel and including a fitting post with an enlarged latch button, the fitting post engaging the fitting socket and the latch button engaging the latch socket.

2. The fixing seat structure of claim 1 wherein the fitting channel has a cruciform configuration.

* * * * *